United States Patent [19]

Hafke et al.

[11] 4,071,332

[45] Jan. 31, 1978

[54] PROCESS OF GASIFYING SOLID FUELS, PARTICULARLY COAL

[75] Inventors: Carl Hafke, Frankfurt; Rudolf Kohlen, Wehrheim, both of Germany

[73] Assignee: Metallgesellschaft Aktiengesellschaft, Frankfurt am Main, Germany

[21] Appl. No.: 715,075

[22] Filed: Aug. 17, 1976

[30] Foreign Application Priority Data

Feb. 26, 1976 Germany ..... 2607743

[51] Int. Cl.[2] ..... C10J 3/16

[52] U.S. Cl. ..... 48/202; 48/206; 252/373

[58] Field of Search ..... 48/197 R, 202, 203, 48/206, 210, 204, 67, 68; 252/373

[56] References Cited

U.S. PATENT DOCUMENTS

| | | | |
|---|---|---|---|
| 3,892,542 | 7/1975 | Zimmerman et al. | 48/67 |
| 3,930,811 | 1/1976 | Hiller et al. | 48/68 |
| 3,937,620 | 2/1976 | Rudolph et al. | 48/68 |
| 3,970,437 | 7/1976 | Livemore | 48/68 |
| 3,979,328 | 9/1976 | Pockrandt | 252/373 |

*Primary Examiner*—S. Leon Bashore
*Assistant Examiner*—Peter F. Kratz
*Attorney, Agent, or Firm*—Burgess, Dinklage & Sprung

[57] ABSTRACT

In a process of gasifying solid fuel such as coal comprising the steps of contacting the solid fuel under a pressure of at least about 5 bars in a reaction chamber surrounded by a water-cooled zone, the reaction heat evaporating water in said zone, transferring the water vapor from said zone to the reaction chamber, removing product gas from the reaction chamber, scrubbing and cooling said product gas in a scrubber-cooler, and periodically interrupting normal gasification, the improvement which comprises discontinuing the transfer of water vapor to the reaction chamber during such periods of other than normal gasification and instead transferring the water vapor to said scrubber-cooler, whereby generation of product gas will be discontinued during such periods. Hot steam may be supplied to the water-cooled zone during said periods of interruption to delay a drop in the temperature of the fuel in the reactor chamber so that upon resumption of normal operation the initially produced gas wll be of substantially normal composition.

3 Claims, 1 Drawing Figure

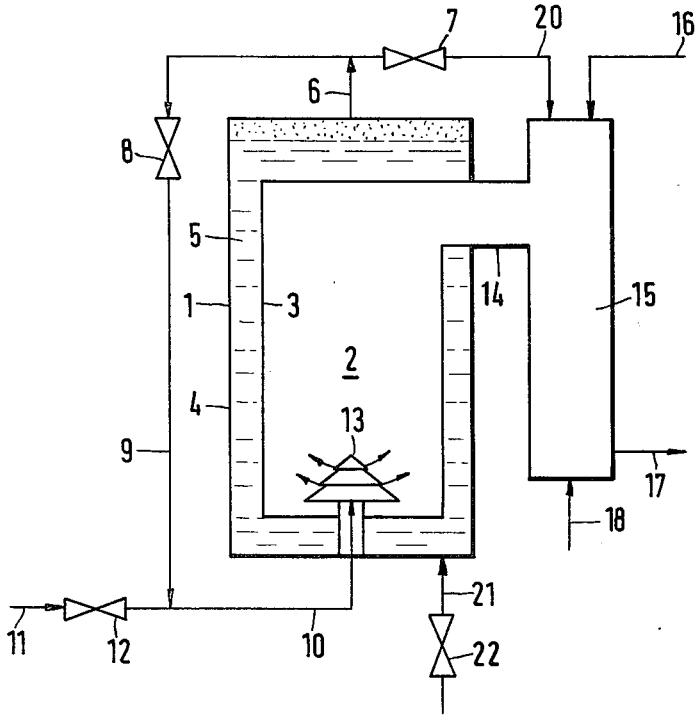
7
20
16
6
8
5
1
3
14
15
2
4
13
9
17
18
21
11
12
10
22

PROCESS OF GASIFYING SOLID FUELS, PARTICULARLY COAL

This invention relates to a process of gasifying solid fuels, particularly coal, by a treatment with oxygen and water vapor under a pressure of at least about 5 bars in the reaction chamber of a reactor which comprises a water-cooled jacket, a water vapor transfer conduit leading from the annular chamber of the jacekt to the reaction chamber, and a product gas discharge conduit leading from the reaction chamber to a scrubber-cooler.

It is known that solid fuels can be gasified under pressures in the range of about 5–150 bars, preferably about 10–80 bars, by a treatment with oxygen-containing gas and water vapor. Details of the process and of the pressure reactor and the units associated therewith have been disclosed, e.g., in Printed German Application No. 1,021,116, German Pat. No. 2,352,900, and U.S. Pat. Nos. 2,667,409; 3,930,811; 3,902,872; and 3,937,630, the disclosures of which are incorporated herein by reference. The solid fuels to be gasified include mainly hard coal, brown coal, and peat. During the pressure gasification the granular fuels are held in a packed bed and the gasifying agents flow opposite to the direction of movement of the solids. The gas produced by the gasification is fed in known manner to a scrubber cooler, in which the gas is cooled and coarsely purified.

The known pressure gasification reactors have a water-cooled jacket, in which a so-called jacket steam is produced, which is used as a gasifying agent. The cooling jacket communicates with the reaction chamber of the pressure reactor through a jacket steam transfer conduit, which provides for an equalization of pressure between the interior of the reactor and of the jacket. This equalization of pressure affords a desired protection of the inner shell of the reactor so that said inner shell may be designed to withstand only a relatively low pressure load. It has now been found that this pressure-equalizing communication between the cooling jacket of the reactor and the reaction chamber may result in difficulties when the gasification operation is temporarily shut down in that the feeding of the oxygen-containing gasifying agents to the fuel bed is discontinued. In this case the heat obtained in the gasification system results in a continued generation of water vapor in the cooling jacket of the pressure reactor. When the transfer of said steam through the jacket steam transfer conduit into the fuel bed is continued, the still hot carbonaceous material will react with the water vapor and will thus be cooled.

The shutdown results also in a pressure drop in the reaction chamber so that the evaporation in the cooling water jacket is promoted. Moist water vapor may also promote corrosion in the cooled water. When the gasification is to be resumed after a temporary shutdown, the cooled fuel bed must be reheated first so that an inferior product gas is initially produced. This product gas must be flared in most cases.

It is an object of the invention to minimize the cooling of the coal bed during a temporary shutdown of the gasification operation. This is accomplished according to the invention in that water vapor from the reactor jacket is directly fed into the scrubber-cooler under conditions other than those of normal gasification. Different from normal operation, the jacket steam is no longer transferred into the reaction chamber and can no longer result in a cooling in said area. Because the jacket steam is directly fed into the scrubber-cooler and the scrubber-cooler communicates with the reaction chamber through the product gas discharge conduit, the equilization of pressure between the reaction chamber and the interior of the reactor jacket is maintained during the shutdown. As a result, the trouble arising during a temporary shutdown is minimized and the energy loss is low. This obviously promotes the economy of the pressure gasification of solid fuels.

An example of the process according to the invention will be explained with reference to the drawing which is a schematic flow sheet of the process according to the invention.

A known pressure gasification reactor is designated 1. Details of the construction of said reactor are not shown on the drawing. Fuels forming a packed bed in the reacton chamber 2 in the interior of the reactor are gasified therein under superatmospheric pressure. The fuels are fed from above and residual ash is discharged from the lower end of the reactor by means which are not shown. The reaction chamber 2 is surrounded by an inner shell 3 and an outer shell 4. Cooling water 5 boils under pressure between the two shells 3 and 4 to produce the so-called jacket steam, which is discharged through conduit 6. During normal gasification operation the valve 7 is closed and the valve 8 is open so that the jacket steam is transferred through conduits 9 and 10 into the reaction chamber. When the valve 12 is open, a mixture of oxygen-containing gas and extraneous steam from conduit 11 is added to the jacket steam and the resulting mixture is then distributed into the fuel bed by a rotary grate 13.

The raw product gas which has been produced in the reaction chamber 2 is fed through discharge conduit 14 to the scrubber-cooler 15 and is sprayed therein with water and condensate from conduit 16. The condensate has been derived from the raw gas. Scrubbed gas leaves the scrubber-cooler 15 through conduit 17, and liquid is withdrawn through conduit 18.

When the pressure gasification operation must be temporarily shut down and is to be subsequently resumed, the valve 12 is closed to discontinue the supply of oxygen-containing gas to the reaction chamber 2. At the same time, the valve 7 is opened so that the jacket steam which is still being produced is fed through conduit 20 to the scrubber-cooler 15. The valve 8 is closed so that water vapor can no longer enter the still hot coal bed above the rotary grate 13.

When it is desired to compensate entirely or in part for the heat loss from the cooling water jacket, the valve 22 is opened and hot extraneous steam is fed through conduit 21 into the water jacket.

In case of a shutdown, the feeding of the jacekt steam into the scrubber-cooler and the required shutoff of the jacket steam transfer conduit leading to the reaction chamber 2 may easily be effected by automatically operated means if a control signal is produced by the valve 12 when the same is closed to interrupt the oxygen supply. This control pulse may be used to control actuators, not shown, for the valves 7 and 8 in such a manner that valve 7 is opened and valve 8 is closed. When the normal gasification operation is to be resumed, valves 8 and 12 are opened and valve 7 is closed. Thus the valves 7 and 8 are oppositely actuated and may be interlocked to prevent the closing of both valves at any time. This may also be effected by automatically operated control means.

It will be appreciated that the instant specification and examples are set forth by way of illustration and not limitation, and that various modifications and changes may be made without departing from the spirit and scope of the present invention.

EXAMPLE

To an apparatus such as illustrated in the drawing with a cylindrical reaction chamber 2.75 m in diameter and 8.5om high coal is supplied at the rate of 9,000 kg per hour, forming a packed bed. The gas pressure inside chamber 2 is 24.0 kg/cm$^2$. The cooling water 5 is at a temperature of 221° C and pressure of 24.3 kg/cm$^2$. The generated steam passes open valve 8 and enters the reaction zone at the rate of 1.300 kg per hour. Valve 12 is open and 3.700 kg per hour of oxygen plus 12.500 kg per hour of steam are additionally introduced into the reactor. There are removed 1,800 kg per hour of solids, mostly ash, and 23,400 kg per hour of gas of the following composition by volume:

$CO = 14.3\%$ $CnHm = 0.5\%$
$H_2 = 23.8\%$ $CH_4 = 5.4\%$
$CO_2 = 17.6\%$ $N_2 = 0.5\%$
$H_2O = 37.9\%$

When the gasification is interrupted valve 12 is closed, valve 8 is closed and valve 7 is opened. Thus steam which is still being produced from cooling water 5 bleeds off through line 20 into the scrubber 15. By opening valves 8 and 12 and closing valve 7 gas generation is resumed without a lengthy induction period.

What is claimed is:

1. In a process of gasifying solid fuel such as coal comprising the steps of contacting a bed of solid fuel with oxygen and water vapor under a pressure of at least about 5 bars in a reaction chamber surrounded by a water-cooled zone, the reaction heat evaporating water in said zone, transferring the water vapor from said zone to the reaction chamber, removing product gas from the reaction chamber and feeding it into a scrubber-cooler, scrubbing and cooling said product gas in the scrubber-cooler, and periodically interrupting normal gasification, the improvement which comprises discontinuing the transfer of water vapor to the reaction chamber during such periods of other than normal gasification and instead transferring the water vapor to said scrubber-cooler.

2. A process according to claim 1, including the step of feeding hot steam into the water-cooled zone when the normal gasification operation is interrupted, thereby delaying a drop in the temperature in the fuel in the reactor chamber.

3. A process according to claim 1, wherein the feeding of water vapor to the scrubber-cooler is not initiated until the feed of oxygen into the reactor has been discontinued, and shut-off valves controlling steam transfer to the chamber or the scrubber-cooler are oppositely actuated and interlocked to prevent a closing of both valves at any time.

* * * * *